US005944483A

United States Patent [19]

Beck et al.

[11] Patent Number: 5,944,483

[45] Date of Patent: Aug. 31, 1999

[54] METHOD AND APPARATUS FOR THE WET CLEANING OF THE NOZZLE RING OF AN EXHAUST-GAS TURBOCHARGER TURBINE

[75] Inventors: André Beck, Concord, N.C.; Dieter Häberle, Weilheim, Germany; Johann Kronthaler, Ennetbaden, Switzerland; Gavin John Menzies, Niederrohrdorf, Switzerland; Dirk Telschow, Untersiggenthal, Switzerland; Jonas Zumbrunn, Tenniken, Switzerland

[73] Assignee: Asea Brown Boveri AG, Baden, Switzerland

[21] Appl. No.: 08/759,183

[22] Filed: Dec. 4, 1996

[30] Foreign Application Priority Data

Dec. 29, 1995 [DE] Germany ..... 195 49 142

[51] Int. Cl.[6] ..... F02B 37/00

[52] U.S. Cl. ..... 415/117; 415/116; 60/619; 134/104.1; 134/169 A; 239/553.5; 239/590.5

[58] Field of Search ..... 415/116, 117; 60/619, 39.33; 134/22.1, 22.17, 22.18, 22.19, 104.1, 169 A; 239/553.5, 590.5

[56] References Cited

U.S. PATENT DOCUMENTS

| | | | |
|---|---|---|---|
| 2,549,819 | 4/1951 | Kane | 415/116 |
| 2,775,864 | 1/1957 | Karcher | 415/117 |
| 3,623,668 | 11/1971 | Freid et al. | 415/117 |
| 3,779,213 | 12/1973 | Knudsen | 134/22.18 |
| 3,961,482 | 6/1976 | Jamaux | 415/116 |
| 4,046,155 | 9/1977 | Mansson | 134/169 A |
| 4,295,895 | 10/1981 | Kongshaug | 134/22.18 |
| 4,548,040 | 10/1985 | Miller et al. | 60/619 |
| 4,713,120 | 12/1987 | Hodgens, II et al. | 134/22.17 |
| 5,011,540 | 4/1991 | McDermott | 134/22.18 |
| 5,193,976 | 3/1993 | Kolev et al. | 415/116 |
| 5,518,182 | 5/1996 | Sasao | 239/553.5 |

FOREIGN PATENT DOCUMENTS

| | | | |
|---|---|---|---|
| 1147085 | 4/1963 | Germany . | |
| 2002084 | 9/1970 | Germany | 415/116 |
| 2008503 | 2/1971 | Germany . | |
| 2155897 | 5/1972 | Germany . | |
| 3220081 | 8/1983 | Germany . | |
| 3515825 | 11/1985 | Germany . | |
| 3832338 | 9/1989 | Germany . | |
| 55-54672 | 4/1980 | Japan | 415/116 |
| 642873 | 5/1984 | Switzerland . | |
| 2032002 | 4/1980 | United Kingdom | 60/619 |
| 2158519 | 11/1985 | United Kingdom . | |

*Primary Examiner*—Christopher Verdier
*Attorney, Agent, or Firm*—Burns, Doane, Swecker & Mathis, L.L.P.

[57] ABSTRACT

A method for wet cleaning of the nozzle rings of exhaust-gas turbocharger turbines is based on thermal shock of the contaminants, and includes the steps of injecting water in repeated, relatively small amounts, into the exhaust duct immediately upstream of the nozzle ring. A delay between injections allows the nozzle ring to reheat to operating temperature so that each water injection causes a thermal shock. An apparatus to perform the method includes water injection nozzles installed in the exhaust gas casing and a control system. The method and apparatus provide improved cleaning using less water than in known methods.

11 Claims, 2 Drawing Sheets

FIG. 1
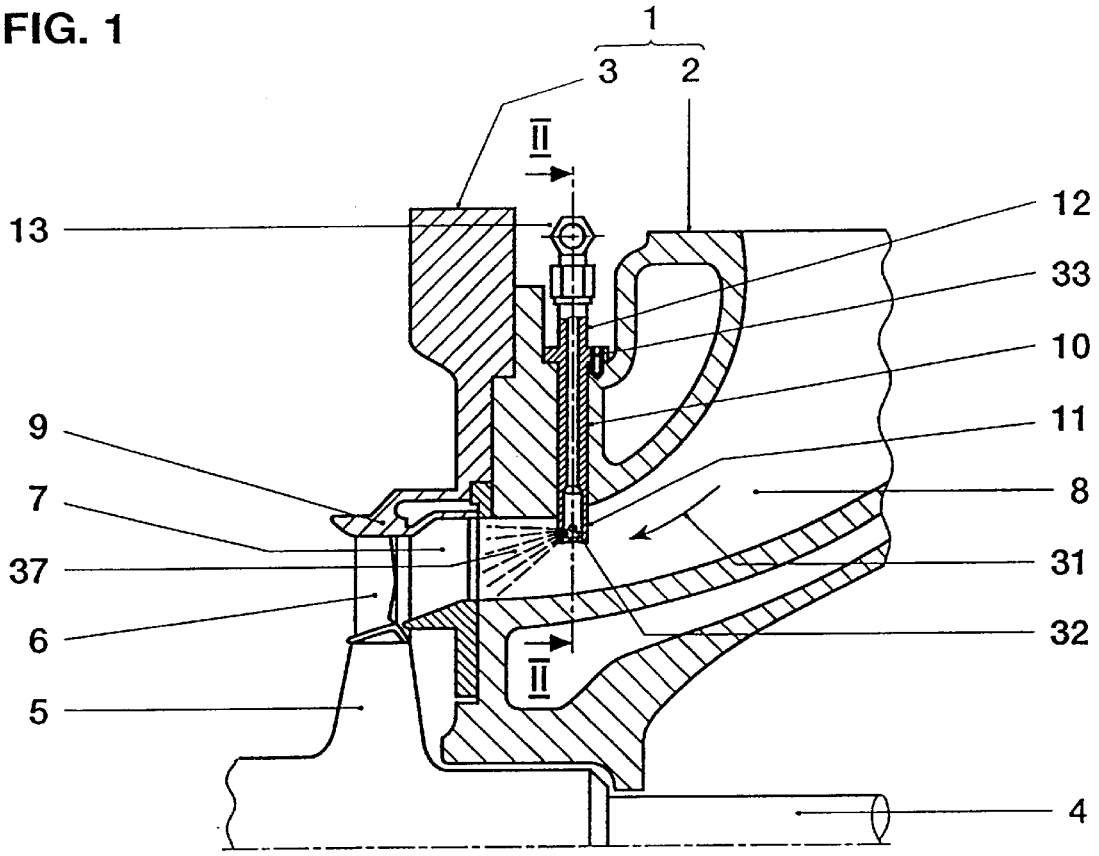
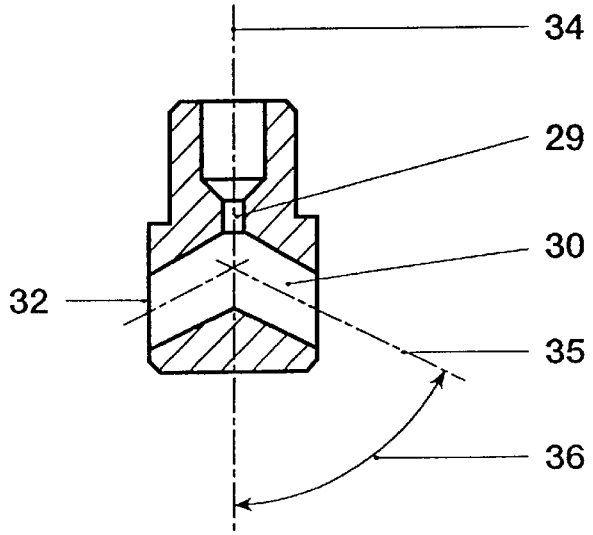
FIG. 3
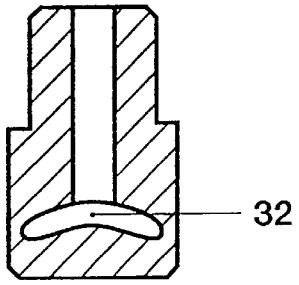
FIG. 4

METHOD AND APPARATUS FOR THE WET CLEANING OF THE NOZZLE RING OF AN EXHAUST-GAS TURBOCHARGER TURBINE

BACKGROUND OF THE INVENTION

1. Field of the Invention

The invention relates to an exhaust-gas turbine of an exhaust-gas turbocharger connected to an internal-combustion engine and a method for the wet cleaning of its nozzle ring.

2. Discussion of Background

The use of exhaust-gas turbochargers for increasing the output of internal-combustion engines is widespread nowadays. Here, the exhaust gases of the internal-combustion engine are admitted to the exhaust-gas turbine of the turbocharger and their kinetic energy is used to draw in and compress air for the internal-combustion engine. As a function of the actual operating situation and the composition of the fuels used to drive the internal-combustion engine, contamination of the moving blades and nozzle ring occurs in the exhaust-gas turbine sooner or later, the nozzle ring being affected to a substantially greater extent. In heavy-oil operation, a hard layer of contamination forms on the nozzle ring. Such contamination deposits in the region of the nozzle ring lead to a poorer turbine efficiency and consequently to a reduction in the output of the internal-combustion engine. In addition, an increase in the exhaust-gas temperatures and the pressures occurs in the combustion chamber, as a result of which the internal-combustion engine and in particular its valves may be damaged or even destroyed. Therefore the nozzle ring must be regularly freed of the contaminants adhering to them.

Cleaning the nozzle rings in the dismantled state requires the turbocharger to be shut off for a longer period and is therefore undesirable. Consequently, cleaning methods have gained acceptance in which the turbocharger can remain in operation and does not have to be dismantled. Wet cleaning with water and dry cleaning with a granulated material are known as suitable methods of removing nozzle-ring contaminants. The requisite cleaning agent is fed in upstream of the exhaust-gas turbine in the region of the exhaust-gas line connecting the exhaust-gas turbine to the internal-combustion engine.

During the wet cleaning, a large portion of the water used vaporizes on account of the high exhaust-gas temperatures of the internal-combustion engine. Therefore only a portion of the water can be utilized for the cleaning. At full load of a four-stroke internal-combustion engine, the temperatures of the components located at the turbine inlet are above the maximum value admissible for the wet cleaning. In order to avoid thermal damage to the nozzle ring, the moving blades, the cover ring and the turbine casing, the output of the internal-combustion engine has to be reduced before the entry of water into the exhaust-gas turbine. On account of the different expansion of casing and turbine impeller, touching of the turbine impeller at its cover ring may also occur during greater temperature fluctuations. Efficiency losses are associated therewith on the one hand, and unbalance may develop on the other hand. In addition, energy is extracted from the exhaust gases by the vaporization of the water, so that the rotational speed of the exhaust-gas turbine and thus the output of the compressor drop. This is accompanied by an additional decrease in output of the internal-combustion engine.

These disadvantages do not occur during the dry cleaning. However, the use of granulated material may lead to erosion problems in the turbine casing, at the nozzle ring and at the moving blades of the exhaust-gas turbine.

The greatest disadvantage of both methods is the nonuniform distribution of the cleaning agent, for which reason only certain regions of the fixed nozzle ring come in contact with this cleaning agent. Consequently, the contaminants can only be partly removed, so that the cleaning result of these two methods primarily based on the mechanical action of the cleaning agent is inferior to cleaning in the dismantled state. Therefore, although the time intervals up to the next complete cleaning of the nozzle ring can be increased with these solutions, the is dismantling of the turbocharger for cleaning purposes remains imperative.

SUMMARY OF THE INVENTION

Accordingly, one object of the invention, in attempting to avoid all these disadvantages, is to provide a novel method and a novel apparatus for the wet cleaning of the nozzle rings of exhaust-gas turbocharger turbines, with which an improved cleaning action is achieved despite the use of lower quantities of water. In addition, the output of the internal-combustion engine before the start of the cleaning operation is to be reduced to a lesser extent than hitherto necessary and the operational reliability of the exhaust-gas turbocharger is to be increased.

According to the invention, this is achieved in a method in which, after the cleaning requirement is established, a cleaning cycle which runs automatically is activated, in which the water is briefly injected repeatedly into the region upstream of the nozzle ring and an injection pause for reheating the nozzle ring is maintained between the injection operations.

To this end, at least one radial recess is formed in the gas-inlet casing, specifically in the region upstream of the nozzle ring. An injection nozzle is arranged in each recess and is connected in each case via a line to the feed line for the water. A control element is arranged between the measuring element recording the changes of state of the exhaust gases of the internal-combustion engine connected to the exhaust-gas turbine and the actuator located in the feed line.

This design of the gas-inlet casing enables the water to be injected into the region directly upstream of the nozzle ring. The control element regulates the cleaning cycle described above. In the process, the relatively cold water, after injection into the exhaust-gas flow of the internal-combustion engine, is carried along by the exhaust-gas flow to the nozzle ring. There, it strikes the contamination deposits of the nozzle ring, which are suddenly cooled down very intensely by the vaporization of the water on the surface. With this thermal-shock treatment, the breakdown of the layer of contamination occurs and, during repeated use, a cleaner nozzle ring is obtained. In addition to the intended effect, a cleaning action also occurs on the blades of the turbine impeller. On account of the brief injection, only comparatively small quantities of water are used. The uniform admission of water leads to lower thermal loading of the turbine components, which substantially reduces their thermal damage. The requisite lowering of the exhaust-gas temperature, i.e. of the output of the internal-combustion engine, before the start of the cleaning operation is therefore much less than was hitherto necessary. Therefore the internal-combustion engine may be operated at a higher load during the cleaning of the nozzle ring.

In the case of relatively soft deposits on the nozzle ring, this apparatus can also be used advantageously for the conventional methods of wet cleaning, i.e. for the cleaning principles based on the mechanical cleaning action of the water.

A further advantage of the clearly reduced injection quantity of the water consists in the fact that the casing and the impeller of the exhaust-gas turbine undergo less expansion during the cleaning operation. Thus the risk of touching of the turbine impeller at the cover ring and the disadvantages associated therewith can be avoided. In addition, a substantially smaller quantity of water is vaporized by the hot exhaust gases of the internal-combustion engine. The exhaust gases thereby experience a lower energy loss compared with the known solutions of the prior art for wet cleaning, so that the rotational speed of the exhaust-gas turbine and thus the output of the compressor remain essentially constant. In this way, the decrease in output of the internal-combustion engine during the wet cleaning can be significantly reduced.

It proves to be especially favorable if up to five injection operations take place one after the other, and a duration of injection of less than ten seconds per injection operation as well as an injection pause of at least twenty times the duration of injection are maintained. With this method, both optimum cleaning of the nozzle ring and minimum thermal loading of the turbine components are ensured.

Furthermore, it is especially expedient if the injection nozzles extend into the flow duct only up to and including their orifices. The impairment of the exhaust-gas flow consequently remains slight and the efficiency loss of the turbocharger in this respect becomes negligible.

It is especially advantageous if the water is injected into the flow duct at right angles to the flow direction of the exhaust gas. Although the injection nozzles are arranged directly upstream of the nozzle ring, their number can thereby be kept relatively small. To this end, each injection nozzle has a choke point, adjoining which downstream are two distribution passages which are designed with a greater overall diameter than the diameter of the choke point. The distribution passages in each case lead at the side of the injection nozzle and at right angles to the flow direction of the exhaust gases into the flow duct. On account of the jump in diameter from the choke point to the two distribution passages, the latter are not completely filled with water. The water is therefore injected into the flow duct in each case in the form of a flat jet. A water curtain striking the nozzle ring over a wide front develops due to the effect of the exhaust-gas flow on the flat jets injected at right angles. Despite a greatly reduced water input, a plurality of blades of the nozzle ring are uniformly wetted in this way. Distinctly improved cleaning of the nozzle ring is thereby achieved.

It is of advantage if the feed line branches upstream into a water line and into an air line, a second actuator is arranged in the latter, and this actuator is likewise connected to the control element. A check valve is arranged in each case in the water and air line. Sealing air can thereby be introduced via the injection nozzles during both the injection pauses of a cleaning cycle and the period between the cleaning cycles so that these injection nozzles do not become cloggea. The check valves prevent the ingress of the hot exhaust gases into the feed line and thus possible destruction of the actuators arranged upstream.

Finally, a ring line is arranged in or on the gas-inlet casing, which ring line connects the lines leading to the injection nozzles to the feed line. In this solution, a space-saving arrangement in the region of the gas-inlet casing is obtained owing to the fact that the ring line only has to be connected to the feed line at one point and the further distribution of the water up to the injection nozzles can be effected internally.

With appropriate geometry of the gas-inlet casing, injection nozzles are used which inject the water in the flow direction of the exhaust gas into the flow duct. To this end, their orifices are oriented in the flow direction of the exhaust gases.

It is advantageous if effective cleaning additives are added to the water before the injection into the flow duct. The cleaning action can be further improved by such a method.

The principle of the thermal shock may be used not only for cleaning the nozzle rings and moving blades of turbocharger exhaust-gas turbines but also for other components arranged in the exhaust-gas tract of fluid-flow machines and combustion engines, e.g. for the blades of a gas turbine or in a waste-heat boiler. Likewise, such machines may first be dismantled, and the contaminated components may be heated separately and then briefly cooled down to a considerable extent.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing of the axial turbine of an exhaust-gas turbocharger, wherein:

FIG. 1 shows a partial longitudinal section of the exhaust-gas turbine;

FIG. 3 shows an enlarged section through one of the injection nozzles shown in FIG. 2;

FIG. 4 shows a representation of an injection nozzle analogous to FIG. 3 but in a second exemplary embodiment.

Figure 2:
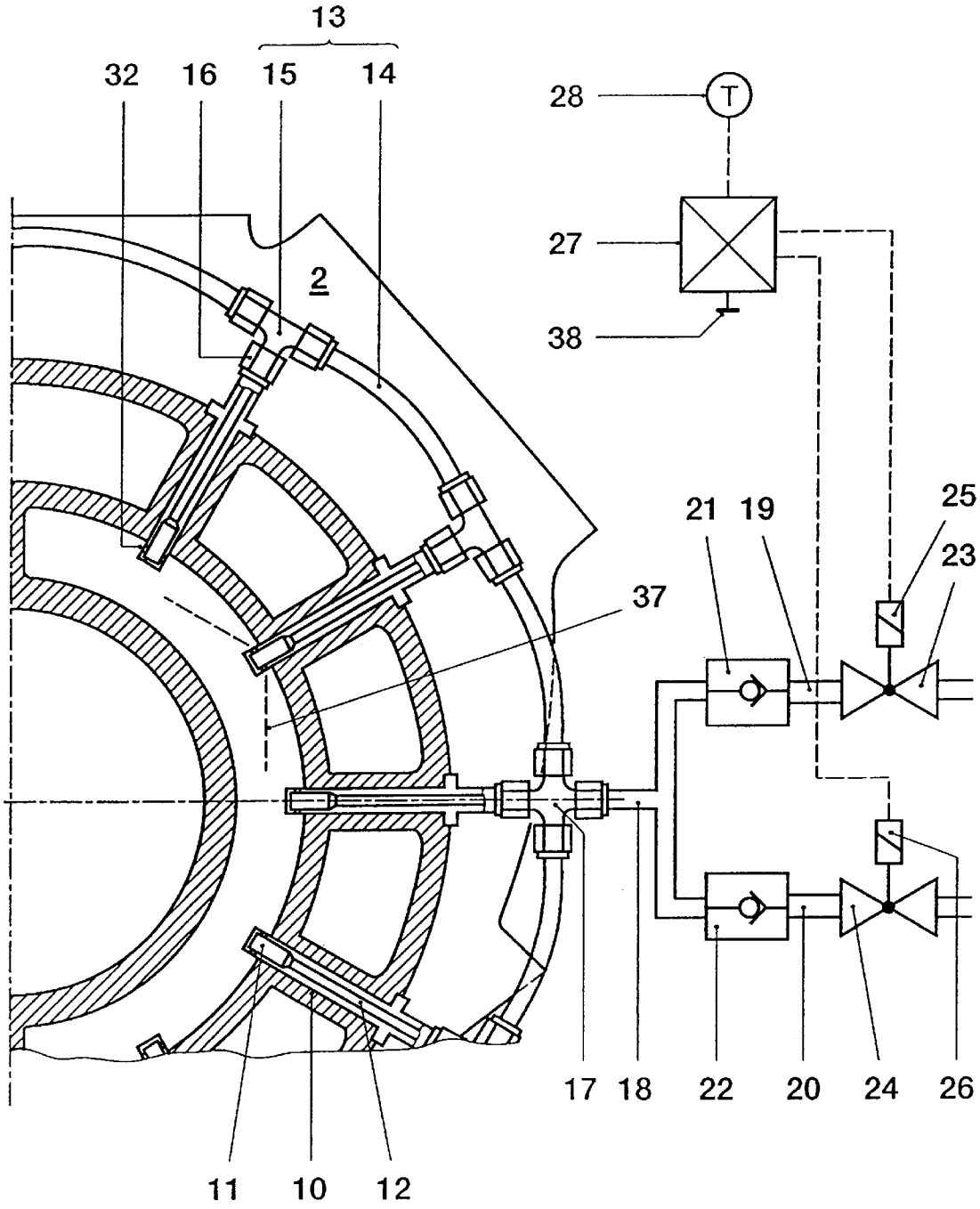
FIG. 2 shows a cross section through the cleaning apparatus along line II—II in FIG. 1 including the control system.

Only the elements essential for understanding the invention are shown. The internal-combustion engine and the compressor side of the exhaust-gas turbocharger, for example, are not shown.

DESCRIPTION OF THE PREFERRED EMBODIMENTS

Referring now to the drawings, wherein like reference numerals designate identical or corresponding parts throughout the several views, the exhaust-gas turbine of a turbocharger has a turbine casing 1 which is formed by a gas-inlet and a gas-outlet casing 2, 3. A turbine impeller 5, carried by a shaft 4 and having moving blades 6, and upstream thereof a nozzle ring 7 are arranged in the turbine casing 1 (FIG. 1). Formed between the turbine impeller 5 and the turbine casing 1 is a flow duct 8 which receives the exhaust gases of a diesel engine (not shown) connected to the turbocharger and passes them on to the turbine impeller 5. The turbine impeller 5 is bounded an the outside by a cover ring 9.

In the region upstream of the nozzle ring 7, ten radial recesses 10 are arranged in the gas-inlet casing 2 and are uniformly distributed over its periphery (FIG. 2). Each recess 10 accommodates an injection nozzle 11. The injection nozzles 11 are connected via one line 12 each to a ring line 13 fastened on the outside to the gas-inlet casing 2. The ring line 13 may of course also be arranged in the gas-inlet casing 2. To simplify the assembly, the ring line 13 consists of individual line sections 14 which are screwed to one another via T-pieces 15. The lines 12 are fastened to the inwardly projecting end of the corresponding T-piece 15 by means of one fitting connection 16 each. A cross 17 is arranged in the ring line 13 in place of one of the T-pieces 15. In addition to the corresponding line 12, a feed line 18 acts on the cross 17, which feed line 18 branches upstream into a water line 19 and an air line 20. A check valve 21, 22 is arranged in each case in the water line 19 and in the air line 20. Upstream of each check valve 21, 22, an actuator 23, 24 designed as a two-way valve is arranged in the water line 19 and the air line 20 respectively. The two-way valves 23, 24 are operatively connected to a common control element 27 in each case via a magnet actuation 25, 26, which control element 27 in turn interacts with a measuring element 28 designed as a heat sensor. The heat sensor 28 is arranged in an exhaust-gas line (not shown) of the internal-combustion engine, which exhaust-gas line is connected to the exhaust-gas turbine. An arrangement of the heat sensor 28 in the flow duct 8 is likewise possible. The water line 19 is connected to a water reservoir (not shown) and the air line 20 is connected to the compressor (likewise not shown) of the exhaust-gas turbocharger. External compressed air may of course also be supplied.

Each injection nozzle 11 has a choke point 29, adjoining which downstream are two distribution passages 30, the overall diameter of which is designed to be greater than the diameter of the choke point 29 (FIG. 3). Both distribution passages 30 have a lateral orifice 32 leading into the flow duct 8, which orifice 32 is oriented at right angles to the flow direction 31 of the exhaust gases. The orifices 32 are fixed in the requisite direction by means of an adjusting screw 33 fastened in the gas-inlet casing 2. The injection nozzles 11 are fastened in the recesses 10 in such a way that only their orifices 32 reach into the flow duct 8 (FIG. 2). Each injection nozzle 11 has a center perpendicular 34 and the distribution passages 30 each have a center axis 35. An injection angle 36 of about 60 degrees is formed between the center perpendicular 34 and each of the center axes 35 (FIG. 3). Another injection angle 36 may be selected as a function of the casing construction.

During operation of the exhaust-gas turbocharger, the exhaust-gas temperature of the internal-combustion engine is constantly measured by the heat sensor 28. In the event of a corresponding temperature increase of the exhaust gases, which temperature increase may be attributed to the contamination of the nozzle ring 7, the two-way valve 23 is activated via the magnet actuation 25 or the control element 27 so that water 37 is injected through the injection nozzle 11 into the flow duct 8 of the exhaust-gas turbine. Of course, another controlled variable, such as, for example, the pressure of the exhaust gases or the rotational speed of the turbocharger, may be recorded and a measuring element suitable for this may be arranged.

After the cleaning requirement is established, a cleaning cycle which runs automatically is activated manually via a pushbutton 38 connected to the control element 27. In the process, the water 37 is injected five times in succession into the flow duct 8. The duration of injection is in each case four seconds, an injection pause of in each case five minutes for reheating the nozzle ring 7 and the moving blades 6 being maintained between the individual injection operations. A cleaning sequence differing therefrom may of course also be programmed in accordance with the actual operating conditions. The activation of the cleaning cycle may also be effected automatically.

On account of the design of the injection nozzle 11, lateral injection of the water 37 is effected at right angles to the flow direction 31 of the exhaust gases. Due to the subsequent effect of the exhaust-gas flow on the water 37, a water curtain striking the nozzle ring 7 over a wide front develops. Thus a plurality of blades of the nozzle ring 7 are wetted per injection nozzle 11 in a uniform and purposeful manner so that the cleaning action is improved despite a clearly reduced water input. The injection angle 36 of about 60 degrees permits optimum water distribution, i.e. the striking of the water in the center region of the nozzle ring 7. The risk of touching of the moving blades 6 of the turbine impeller at the cover ring 9 can be reduced, since the latter cools down to a lesser extent on account of the brief water injection.

During the switching operations, the check valves 21, 22 prevent the inflow of the hot exhaust gases into the water line and air line 19, 20 respectively. During both the injection pauses of a cleaning cycle and the period between the cleaning cycles, sealing air is constantly fed in through the injection nozzles 11 via the air line 20. To this end, the two-way valve 24 arranged in the air line 20 is always opened by the magnet actuation 26 or the control element 27 when the two-way valve 23 of the water line 19 is closed. The injection nozzles 11 are constantly kept clear by means of the sealing air. The air pressure required for keeping the injection nozzles 11 clear advantageously arises automatically due to the diverting of the compressed air used from the compressor of the exhaust-gas turbocharger.

In a second exemplary embodiment, each injection nozzle 11 is provided with only one orifice 32 (FIG. 4). The orifices 32 are oriented in the flow direction 31 of the exhaust gases. Of course, there may also be arranged a plurality of orifices 32 of such design per injection nozzle 11. With these orifices 32, the water 37 is injected in the flow direction 31 of the exhaust gas into the flow duct 8.

The principle of the thermal shock is of course not restricted to the cleaning of the nozzle rings 7 and moving blades 6 of turbocharger exhaust-gas turbines but can also be used for other components arranged in the exhaust-gas tract of fluid-flow machines and combustion engines. For example, this may be the blades of a gas turbine or components arranged in a waste-heat boiler. In order to achieve the cleaning effect described, the contaminated components of such machines may first be dismantled, separately heated and then briefly cooled down to a considerable extent.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A method for wet cleaning a nozzle ring of an exhaust-gas turbine, comprising the steps of:

a) briefly injecting water repeatedly for a selected duration of time into an exhaust-gas flow of an internal-combustion engine, directly upstream of and sufficiently close to the nozzle ring so that water strikes the nozzle ring in liquid form and at a temperature sufficiently below an operating temperature of the nozzle ring to cause thermal shock of contaminants on the nozzle ring, b) allowing the nozzle ring to reheat to the operating temperature, and c) repeating step a).

2. The method as claimed in claim 1, wherein five water injection steps are performed, and wherein the duration of each water injection is less than ten seconds and steps of allowing the nozzle ring to reheat are each for a time period of at least twenty times the duration of injection.

3. The method as claimed in claim 1, wherein the water is injected at right angles to the flow direction of the exhaust gas.

4. The method as claimed in claim 1, wherein the water is injected in the flow direction of the exhaust gas.

5. The method as claimed in claim 1, further comprising the step of adding effective cleaning additives to the water before the injection step.

6. An apparatus for wet cleaning a nozzle ring of an exhaust-gas turbocharger turbine, the turbine including at least one turbine casing having a gas-inlet and a gas-outlet casing, a turbine impeller arranged in the turbine casing and carried by a shaft, a flow duct being formed between the turbine impeller and the turbine casing for guiding exhaust gases of an internal combustion engine to the impeller, and the nozzle ring being arranged upstream of the turbine impeller, the apparatus comprising:

a plurality of injection nozzles, each nozzle mounted to a lead line installed in one of a plurality of radially directed recesses formed in the gas-inlet casing in a region upstream of the nozzle ring, each injection nozzle having an interior passage including a choke point and two distribution passages branching from the choke point, the distribution passages having a greater overall diameter than a diameter of the choke point and each distribution passage ending in a laterally directed orifice leading into the flow duct, the orifices being oriented to inject water in the flow duct perpendicular to a flow direction of the exhaust gases, each injection nozzle projecting into the flow duct a length only up to and including the at least one orifice, a feed line connected to feed water to each of the injection nozzles, an actuator arranged in the feed line and operatively connected to a measuring element recording changes in properties of the exhaust gases, and a control element arranged in the feed line between the measuring element and the actuator.

7. The apparatus as claimed in claim 6, wherein each injection nozzle has a center perpendicular axis and the distribution passages each have a center axis and wherein an injection angle of about 60 degrees is formed between the center perpendicular axis and each of the center axes.

8. The apparatus as claimed in claim 6, wherein the orifices of each injection nozzle are oriented in the flow direction of the exhaust gases.

9. The apparatus as claimed in claim 6, wherein the feed line branches upstream into a water line and into an air line, the apparatus comprising a second actuator arranged in the air line, the second actuator being connected to the control element.

10. The apparatus as claimed in claim 9, wherein a check valve is arranged in each of the water line and air line.

11. The apparatus as claimed in claim 6, further comprising a ring line arranged in or on the gas-inlet casing, which ring line connects the lead lines of the injection nozzles to the feed line.

* * * * *